US005199657A

United States Patent [19]

Kästingschäfer et al.

[11] Patent Number: 5,199,657

[45] Date of Patent: Apr. 6, 1993

[54] ROLLER MILL

[75] Inventors: Gerhard Kästingschäfer, Wadersloh; Bernhard Peterwerth, Bad Lear, both of Fed. Rep. of Germany

[73] Assignee: Krupp Polysius AG, Fed. Rep. of Germany

[21] Appl. No.: 705,323

[22] Filed: May 24, 1991

[30] Foreign Application Priority Data

Jun. 12, 1990 [DE] Fed. Rep. of Germany ..... 4018785

[51] Int. Cl.[5] ..... B02C 4/02; B30B 3/00; B30B 11/16

[52] U.S. Cl. ..... 241/235; 241/260

[58] Field of Search ..... 241/235, 236, 242, 260, 241/293, 294; 29/121.1, 121.2, 121.5, 121.6

[56] References Cited

U.S. PATENT DOCUMENTS

| | | | |
|---|---|---|---|
| 1,450,723 | 4/1923 | Gillespie | 241/235 X |
| 2,294,098 | 8/1942 | Stromer . | |
| 2,533,550 | 12/1950 | Blackwell | 241/235 X |
| 3,745,645 | 7/1973 | Kurth et al. | 241/260 X |
| 3,989,441 | 11/1976 | Lauterbach . | |

FOREIGN PATENT DOCUMENTS

| | | | |
|---|---|---|---|
| 0271336 | 6/1988 | European Pat. Off. . | |
| 7803 | of 1884 | United Kingdom | 241/235 |

*Primary Examiner*—Douglas D. Watts
*Attorney, Agent, or Firm*—Learman & McCulloch

[57] ABSTRACT

A roller mill assembly composed of a pair of rollers spaced apart to form a crushing zone therebetween and having recesses which are dimensioned and shaped so that during the grinding process feed material is embedded in the recesses and fills them to increase the draw of feed material into the crushing zone.

10 Claims, 3 Drawing Sheets

ROLLER MILL

TECHNICAL FIELD

Figure 1:
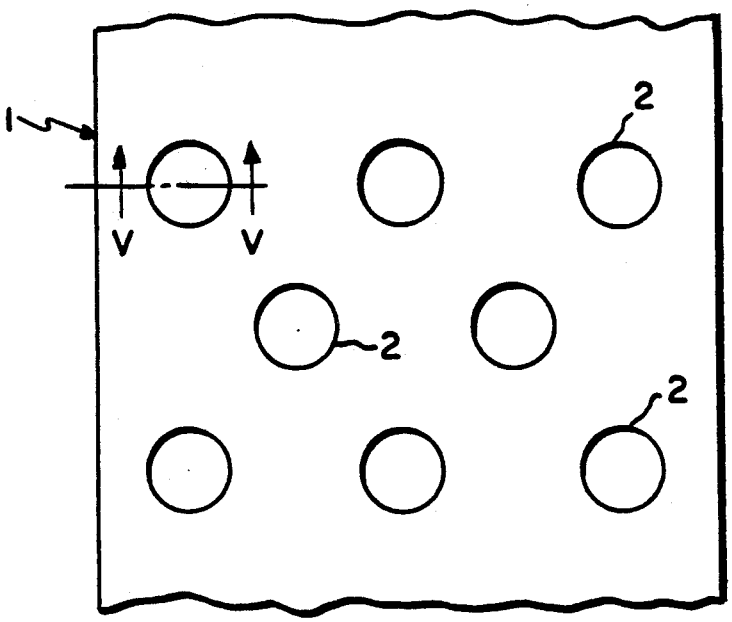

The invention relates to roller mills used to compact and/or crush brittle material in preparation for grinding and more particularly to the construction of rollers for use with such mills.

BACKGROUND OF THE INVENTION

Roller mills of the present type serve as so-called material bed roller mills for compacting and/or crushing brittle material for grinding. Since the rollers are pressed against one another with a very high pressure and the material frequently has a high hardness, considerable wear frequently occurs on the roller surface during the operation of such roller mills.

Rollers are known—in ring or segment construction—with a smooth or profiled peripheral surface. Flanges running in the axial direction have already been proposed as the profiling, these flanges having a relatively low height and being arranged a peripheral distance from one another which amounts to a multiple of the flange height. Rollers are also known in which the surface has flat recesses which are approximately in the shape of oval briquettes.

SUMMARY OF THE INVENTION

According to the invention the rollers are provided with recesses whose dimensions and shapes are chosen in such a way that feed material solidified in the grinding process remains in the recesses and substantially fills them.

In the tests on which the invention is based it was found that with a suitable choice of dimensions and shape of the recesses at the beginning of the grinding operation feed material flows into the recesses and solidifies in these recesses under high grinding pressure. By the construction of the recesses, i.e. in particular by suitable positioning of the opposing side surfaces of the recesses relative to one another and an advantageous ratio of depth to width, the feed material adheres in the recesses and substantially fills the recesses so that the feed material embedded in the recesses forms a common surface together with the hard material layer of the roller.

In this case the surface of the solidified feed material embedded in the recesses has a substantially higher roughness than the surface of the hard material layer of the roller. As a result the friction between the roller and the feed material increases when feed material is drawn into the roller gap. In the compact zone between the grinding material and the grinding roller a greater compression of the delivered feed material takes place, which brings with it an increase in the nip angle and thus of the throughput.

The average width of the recesses advantageously corresponds to 0.5 to 1.5 times, preferably 0.8 to 1.2 times, the average feed grain size of the material for grinding. Thus the average width of the recesses can advantageously be chosen so as to be approximately the same as the average feed grain size.

The manner of drawing in the feed material depends essentially upon the number of recesses present in the contact zone. The more recesses are located in the contact zone, the better the drawing in of material generally is. In order to ensure even drawing in of material and a high degree of smooth running of the roller mill it is favourable if the proportion of the surface area represented by the recesses relative to the entire surface area of the roller—measured in a narrow zone running in the longitudinal direction of the roller and corresponding to the contact zone—is at least approximately constant over the entire periphery of the roller. Thus the surface of the recesses filled with feed material in the contact region is approximately constant during operation.

By means of the construction of the surface of the roller according to the invention the relative movement (i.e., the slip, the sliding and flowing) between feed material and roller is reduced; at the same time the sliding wear is reduced. The material embedded in the recesses forms an autogeneous wear protection. The quantity of metal wear on the surface of the roller reduced according to the surface conditions. Furthermore the higher friction reduces the danger of extrusion of feed material in the grinding gap; thus a higher maximum grinding pressure is permissible.

In order to minimize the increases in stress occurring in the recesses it is favourable if the opposing side surfaces of the recesses are connected to one another by a concave curved base surface. This ensures only a slight increase in the stress intensity.

THE DRAWINGS

Figure 2:
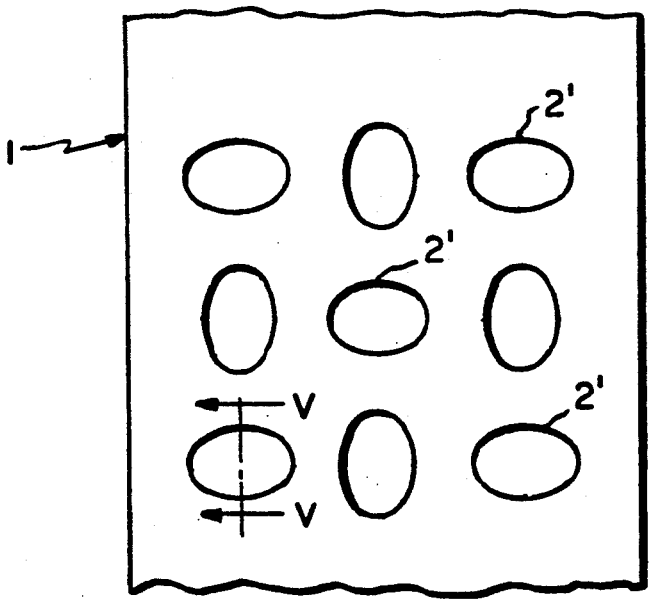
Figure 3:
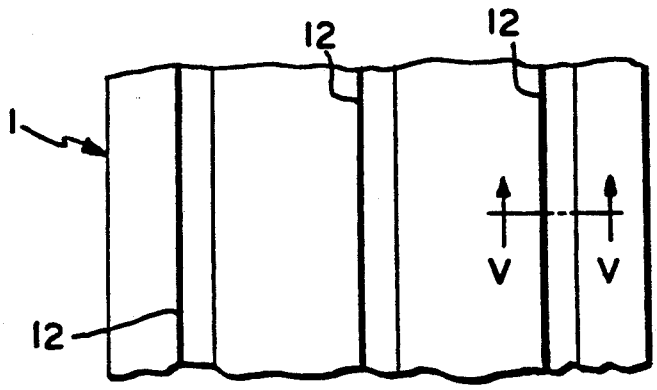
Figure 4:
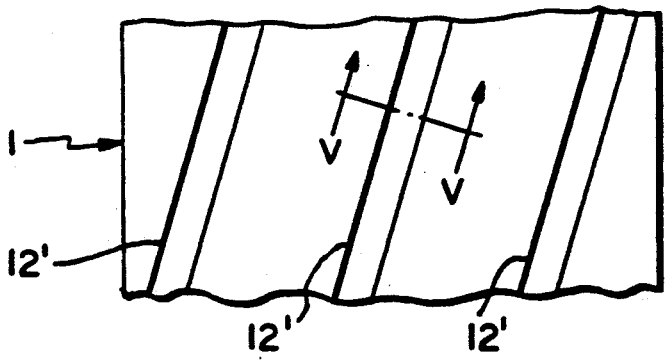
Figure 5:
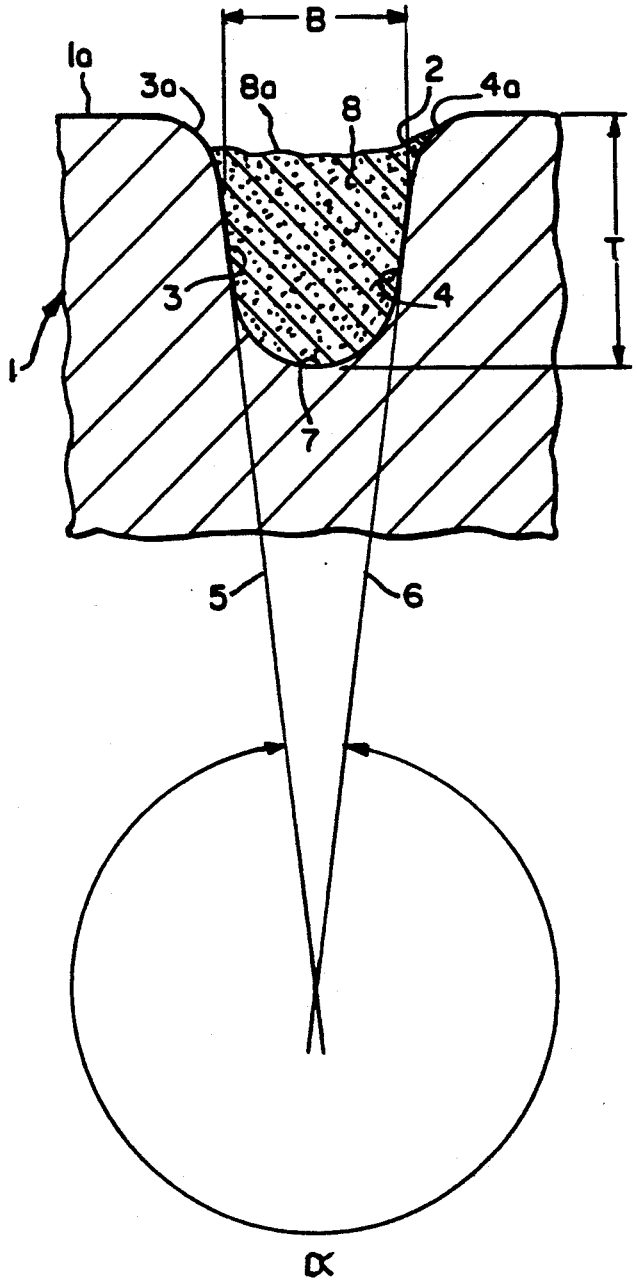

Some embodiments of the invention are illustrated in the drawings, in which:

FIG. 1 shows a top view of a part of a first embodiment of the invention (with round recesses), FIG. 2 shows a top view of a second embodiment (with oval recesses), FIG. 3 shows a top view of an embodiment with groove-shaped recesses running around in the peripheral direction, FIG. 4 shows a top view of an embodiment with recesses running around helically, FIG. 5 shows a section along the lines V—V in FIGS. 1 to 4, and FIG. 6 shows a section (corresponding to FIG. 5) through a somewhat differently shaped recess.

THE PREFERRED EMBODIMENTS

FIG. 1 shows a part of the surface of a roller 1 with a number of round recesses 2. These recesses 2 are advantageously distributed at uniform distances over the roller surface.

FIG. 5 shows (on an enlarged scale) a section (along the line V—V in FIG. 1) through the roller 1 in the region of a recess 2.

The recess 2 is defined by a side wall with opposing side surfaces (e.g. 3, 4 according to FIG. 5), and the average tangents 5, 6 on these side surfaces 3, 4 together form an angle $\alpha$ which is greater than the difference between 360° and 2 times the wall friction angle of the feed material. If the bulk material friction angle is for example 15°, then the angle $\alpha$ is greater than 330°.

The opposing side surfaces 3, 4 of the recesses 2, which make the transition via curves 3*a*, 4*a* into the surface 1*a* of the roller, are connected to one another by a concave curved base surface 7.

The depth T of the recesses 2 is greater than half the average width B of the recesses. In this case the average recess width B is preferably chosen to be approximately equal to the average feed grain size.

At the beginning of the grinding operation feed material 8 flows into the recesses 2 and solidifies therein under the effect of the high grinding pressure. Because of the design of the recesses 2, particularly because of the frontal inclination of the side surfaces 3, 4 and the ratio of T/B, the feed material 8 adheres and remains in the recesses 2. Its surface 8a lies approximately at the height of the roller surface 1a and by its substantially higher roughness improves the drawing in of the feed material into the gap between adjacent rollers 1.

FIG. 2 shows an embodiment of a roller 1 with oval recesses 2'. A section (along the line V—V in FIG. 2) corresponds to the representation in FIG. 5.

Whereas in the embodiments illustrated in FIGS. 1 and 2 the recesses are constructed as individual breaks arranged spaced from one another in the roller surface, FIG. 3 shows a variant in which the recesses 12 are constructed as grooves which run parallel to one another and run in the peripheral direction of the roller 1. Here too a section along the line V—V in FIG. 3 corresponds to the representation in FIG. 5.

FIG. 4 shows a variant in which the recesses 12' of the roller 1 are constructed as grooves which run in the form of single or multiple helical lines.

In the embodiments explained above the angle $\alpha$ (which opposing side surfaces 3, 4 of the recesses form with one another) has a value which is somewhat smaller than 360°.

Within the scope of the invention it is particularly advantageous if the opposing side surfaces 3, 4 of the recesses 2 (or 2', 12, 12') run approximately parallel to one another.

Figure 6:
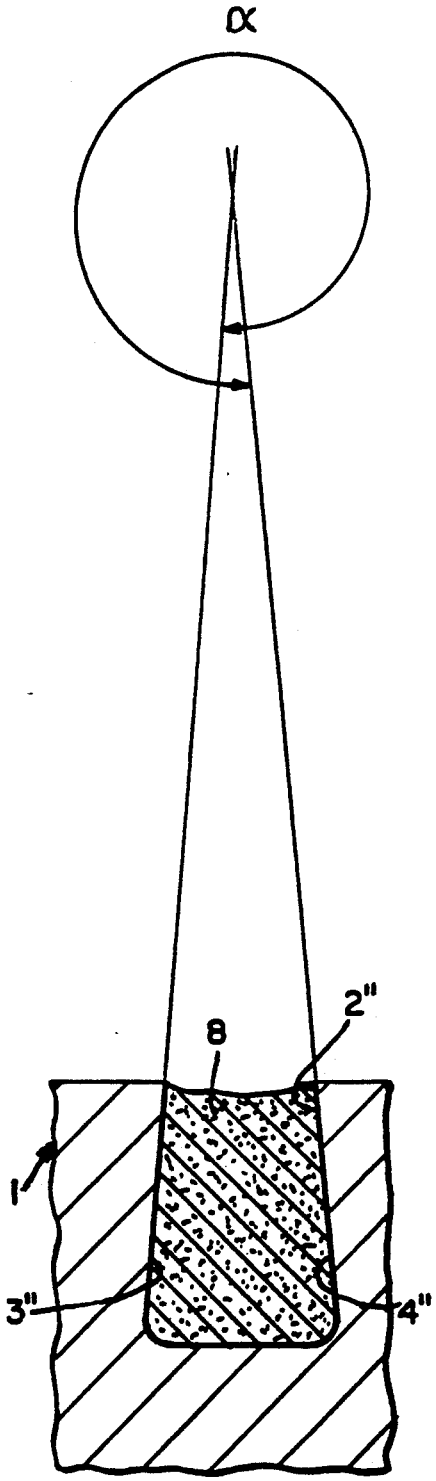

Finally, FIG. 6 shows an example in which the angle $\alpha$ between the side surfaces 3", 4" of the recesses 2" is chosen to be somewhat greater than 360° so that the recesses 2" widen slightly in a dovetail shape towards the interior. In this case the feed material 8 adheres particularly well in the recesses 2".

If the rollers are provided on their periphery with a wear layer, then the recesses according to the invention can be arranged in this wear layer.

If on the other hand the rollers are constructed as solid rollers, then recesses are formed by cut-outs provided in the roller material.

Finally, the roller profile according to the invention can also be produced by build-up welding.

We claim:

1. Roller mill assembly for use in crushing brittle feed material having a characteristic average grain size, said assembly comprising:

a pair of adjacent crushing rollers having means for rotating said rollers in opposite directions, said rollers having respective outer surfaces which are spaced to form a gap therebetween into which the material is fed for crushing, each of said rollers having a plurality of recesses formed in its roller surface, said rollers having means for forcing them toward one another with a force sufficient to crush the material within the gap and cause at least a portion of said material to enter said recesses and solidify therein, each of said recesses having a width approximating the average grain size of the feed material and a depth which is greater than ½ said width thereby enabling the solidified feed material to be embedded in said recesses and fill said recesses so that the embedded feed material forms a common material crushing surface with said roller surfaces.

2. Assembly as set forth in claim 1 wherein opposite side walls of each of said recesses are generally parallel.

3. Assembly as set forth in claim 2 wherein said side walls are connected by a concave base surface defining the bottom of said recess.

4. Assembly as set forth in claim 1 wherein the proportion of the surface area of said recesses relative to the entire surface area of said rollers, measured in a narrow lateral zone extending longitudinally across said rollers and corresponding to a contact zone of the rollers forming said gap, is approximately constant over the entire peripheral crushing surfaces of said rollers.

5. Assembly as set forth in claim 1 wherein said recesses comprise a plurality of grooves extending helically about said rollers.

6. Assembly as set forth in claim 5 wherein each of said grooves has a dovetail cross-sectional shape.

7. Assembly as set forth in claim 1 wherein said width of said recesses is about 0.5 to 1.5 times the average grain size of the feed material.

8. Assembly as set forth in claim 1 wherein said recesses are spaced from one another and have a generally circular shape.

9. Assembly as set forth in claim 1 wherein said recesses are spaced from one another and have a generally oval shape.

10. Assembly as set forth in claim 1 wherein said rollers include an outer wear layer, said recesses being formed in said wear layer.

* * * * *